US011313199B2

(12) United States Patent
Saraya

(10) Patent No.: US 11,313,199 B2
(45) Date of Patent: Apr. 26, 2022

(54) METHODS AND SYSTEMS FOR A TEMPORARY SEAL WITHIN A WELLBORE

(71) Applicant: Vertice Oil Tools, Inc., Missouri City, TX (US)

(72) Inventor: Mohamed Ibrahim Saraya, Sugar Land, TX (US)

(73) Assignee: VERTICE OIL TOOLS INC., Stafford, TX (US)

( * ) Notice: Subject to any disclaimer, the term of this patent is extended or adjusted under 35 U.S.C. 154(b) by 103 days.

(21) Appl. No.: 17/013,694

(22) Filed: Sep. 7, 2020

(65) Prior Publication Data

US 2021/0017833 A1 Jan. 21, 2021

Related U.S. Application Data

(63) Continuation of application No. PCT/US2019/015024, filed on Jan. 24, 2019.

(60) Provisional application No. 62/727,369, filed on Sep. 5, 2018, provisional application No. 62/633,817, filed on Feb. 22, 2018.

(51) Int. Cl.
*E21B 33/12* (2006.01)

(52) U.S. Cl.
CPC ..... *E21B 33/1208* (2013.01); *E21B 2200/08* (2020.05)

(58) Field of Classification Search
CPC ... E21B 33/1208; E21B 2200/08; E21B 34/14
See application file for complete search history.

(56) References Cited

U.S. PATENT DOCUMENTS

| | | | | |
|---|---|---|---|---|
| 5,479,986 | A * | 1/1996 | Gano | E21B 23/04 166/292 |
| 7,513,311 | B2 * | 4/2009 | Gramstad | E21B 34/063 166/376 |
| 7,963,340 | B2 * | 6/2011 | Gramstad | E21B 34/063 166/376 |
| 8,211,247 | B2 * | 7/2012 | Marya | C22C 28/00 148/420 |
| 8,220,538 | B2 * | 7/2012 | Wee | E21B 33/134 166/387 |
| 8,631,876 | B2 * | 1/2014 | Xu | B22F 7/06 166/376 |
| 9,593,542 | B2 * | 3/2017 | Getzlaf | E21B 7/20 |
| 9,624,750 | B2 * | 4/2017 | Entchev | E21B 33/12 |
| 10,092,953 | B2 * | 10/2018 | Mazyar | B22F 1/17 |
| 10,378,303 | B2 * | 8/2019 | Hayter | E21B 33/12 |
| 2009/0101358 | A1 * | 4/2009 | Bjorgum | E21B 33/134 166/376 |
| 2009/0151958 | A1 * | 6/2009 | Gramstad | E21B 34/063 166/376 |
| 2014/0008085 | A1 * | 1/2014 | Tinnen | E21B 33/134 166/134 |

* cited by examiner

*Primary Examiner* — Steven A MacDonald
(74) *Attorney, Agent, or Firm* — Pierson IP, PLLC

(57) ABSTRACT

Examples of the present disclosure relate to a temporary seal within a wellbore. More specifically, embodiments include a temporary seal within casing that limits the flow of fluid through the casing until the temporary seal is released.

20 Claims, 16 Drawing Sheets

METHODS AND SYSTEMS FOR A TEMPORARY SEAL WITHIN A WELLBORE

BACKGROUND INFORMATION

Field of the Disclosure

Examples of the present disclosure relate to a temporary seal within a wellbore. More specifically, embodiments include a temporary seal within casing that limits the flow of fluid through the casing until the temporary seal is released.

Background

Directional drilling is the practice of drilling non-vertical wells. Horizontal wells tend to be more productive than vertical wells because they allow a single well to reach multiple points across a horizontal axis without the need for additional vertical wells. This makes each individual well more productive by being able to reach reservoirs across the horizontal axis. While horizontal wells are more productive than conventional wells, horizontal wells are costlier.

Casing may be run through the drilled horizontal, vertical or deviated wells to reach the reservoirs across the horizontal axis. To take advantage of the buoyancy phenomena to allow moving the casing through, it may be more effective to not fill part of or the entire casing with fluid or fill it with lighter fluid while moving the casing towards the distal end of the horizontal well.

Accordingly, needs exist for systems and methods utilizing a temporary seal within a casing, wherein the temporary seal may be broken by increasing the pressure with in inner diameter of the casing.

SUMMARY

Embodiments disclosed herein describe systems and methods utilizing a temporary seal within a casing, tool, or any other device with an inner diameter (referred to individually and collectively hereinafter as "casing"), wherein the temporary seal may be broken or disengaged by increasing the pressure with in inner diameter of the casing past a pressure threshold.

A first embodiment may include a casing, temporary seal, sliding projection, temporary coupling mechanism, and shearing element.

The casing may be configured to be installed into a well before other tools or equipment is run into the well. The casing may include a hollow channel, passageway, conduit, etc. extending from a proximal end of the casing to a distal end of the casing. The casing may be a hollow diameter pipe that is assembled and inserted into a recently drilled section of a borehole. The casing may include a cutout that increases the inner diameter across the casing, and a lower ledge may be positioned on a distal edge of the cutout. The lower ledge may decrease the inner diameter across the casing.

The temporary seal may be a disc, or any object. The temporary seal may be comprised of breakable or disengaging materials, such as glass, dissolvable or composite materials. In an initial, first position, the temporary seal may be positioned at a first end of the cutout, and extend across the inner diameter of the casing. This may form a temporarily seal across the casing. In embodiments, lower edges of the temporary seal may be positioned on an upper surface of the sliding projection.

The sliding projection may be positioned adjacent to an inner diameter of the casing within the cutout. The sliding projection may be configured to move in a direction in parallel to a longitudinal axis of the casing. An upper surface of the sliding projection may include tapered sidewalls, wherein the upper surface of the sliding projection corresponds with the lower edges of the temporary seal. An outcrop positioned on the sliding projection may include tapered sidewall s.

The temporary coupling mechanisms may be configured to temporarily couple the sliding projection with the shearing element. In some cases, the temporary coupling mechanisms may be shear screws, shear ring, or any other device that is configured to break or be removed once a predetermined amount of force is applied to the temporary coupling mechanisms. Responsive to the pressure within the casing exceeding the pressure threshold, the temporary coupling mechanisms may break. However, in other settings the coupling mechanism may be a thread that couples the sliding projection with the shear ring forming a one unit that contain/sandwich the temporarily seal. The coupling mechanism in this case can only be disconnected by shearing the shear ring In some design the shearing element may be positioned on the ledge within the cutout, and adjacent to an inner surface of the sliding projection. An upper surface of the shearing element may be configured to pierce, shatter, break, deform, etc. the temporary seal responsive to the blade interacting with the temporary seal. In embodiments, the blade may have an angle that is configured to correspond with an angle of the outcrop, wherein the blade extends past the outcrop in a second position. This may allow the blade to touch the temporary seal. In other designs, the shearing element can be an integral part of the segment of the casing which shoulders on a built-in no-go feature in the bottom sub of the tool assembly.

A second embodiment may include casing, a ball or any other geometrical shape, an adjustable or expandable seat or a collet, a holding element, and temporary coupling mechanisms.

In the second embodiment, an inner diameter of the casing may include threads that are configured to interface with the holding element, and a groove configured to interface with the adjustable or expandable seat. The threads may allow the holding element to move along a direction in a parallel to a longitudinal axis of the casing. The groove may be initially positioned below the adjustable or expandable seat in a first position, and be configured to receive the expandable in a second position.

The ball may be any object that has a diameter that is smaller than that of the inner diameter of the casing, is configured to sit on the adjustable or adjustable or expandable seat in the first position, and move through the casing in the second position. The ball or the geometrical shape may include gun drilled holes that extend across diameters, chords, or radius of the ball. The gun drilled holes may allow fluid to flow through the ball. However, a lower portion of the ball may not include any gun drilled inlets or outlets, wherein the lower portion of the ball may be positioned facing the adjustable or expandable seat in the first position. This lack of gun drilled holes on the lower portion of the ball may allow a pressure differential between an area of the casing above and below the ball in the first position while preventing communication between them.

The expandable ball or the geometrical shape seat may be configured to secure the ball within the casing in the first position. The adjustable or adjustable or expandable seat may be comprised of one split circle or two semi-circles with a hollow center. In other embodiments, the adjustable or expandable seat may be any geometric shape that is configured to hold the ball in place, and later expand, adjust or break to no longer secure the ball. The adjustable or expandable seat may be configured to move towards a distal end of the casing based on the pressure within the casing. Responsive to the pressure increasing with the casing, in the second position, the adjustable or expandable seat may move into the cutout and expand.

The holding element may be a device that is configured to be positioned adjacent to the inner sidewalls of the casing. The holding element may include threads that are configured to interface with the threads on the casing, which allow the holding element to be coupled with the casing and move in a direction in parallel to the longitudinal axis of the casing. Utilizing the threads, the holding element may move towards the distal end of the casing, allowing a distal end of the holding element to apply forces against the temporarily seal. Accordingly, in the first position, a lower surface of the temporarily seal may be held in place via the expandable ball seat, and an upper surface of the temporarily seal may be held in place via the holding element.

The temporary coupling mechanisms may be configured to temporarily couple the adjustable or expandable ball seat with the casing. The temporary couple mechanisms may be shear screws, shear ring, or any other device that is configured to break or be removed once a predetermined amount of force is applied to the temporary coupling mechanisms. Responsive to breaking the temporary coupling mechanisms, the adjustable or expandable seat may move from the first position to the second position.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
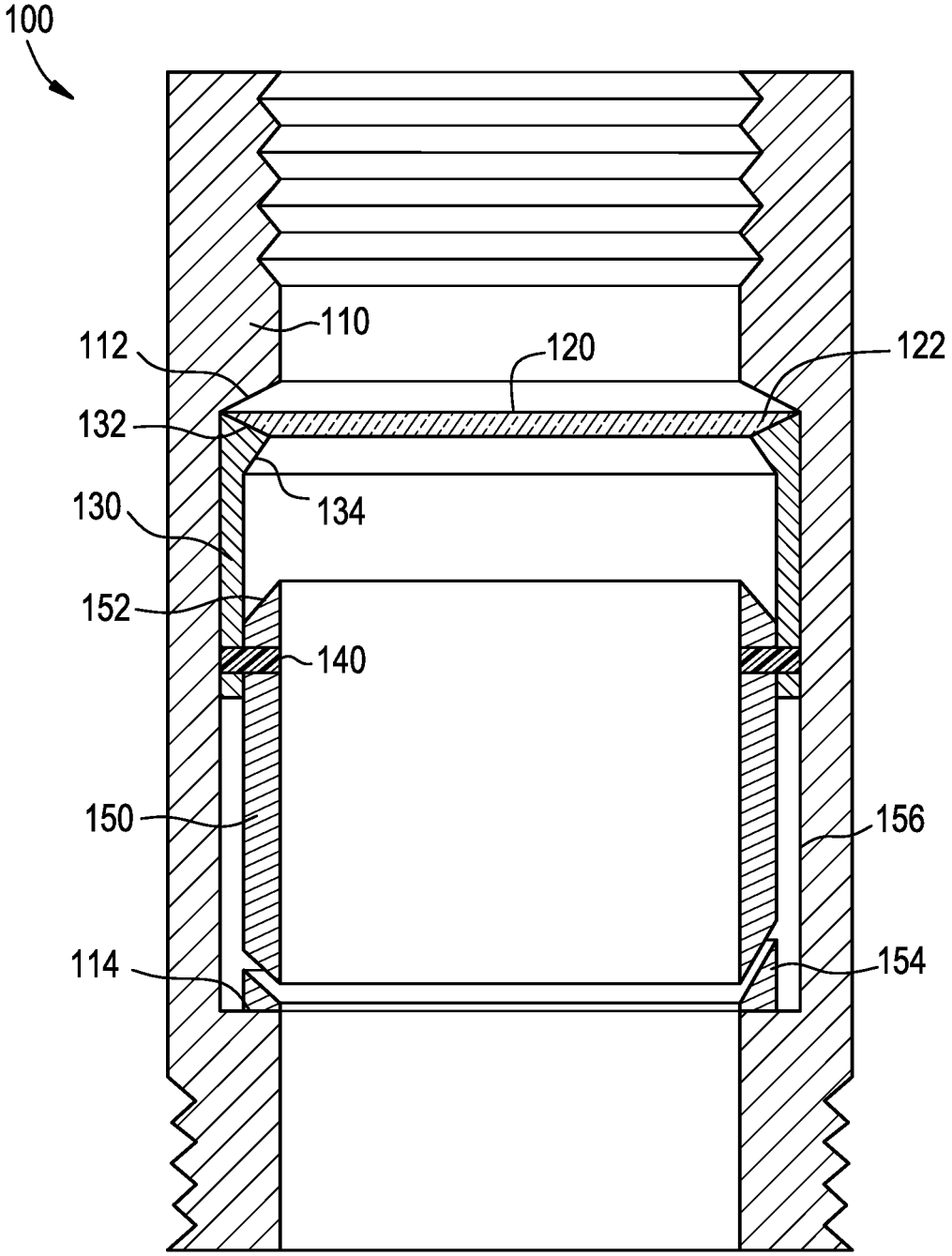
FIG. 1 depicts a system, in a first position, to temporarily seal casing within a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a system 100, in a first position, to temporarily seal casing 110 within a wellbore, according to an embodiment. System 100 may include casing 110, temporary seal 120, sliding projection 130, temporary coupling mechanisms 140, and shearing element 150.

Casing 110 may be configured to be installed into a well before other tools or equipment is run into the well. Casing 110 may be a large diameter pipe that is assembled and inserted into a recently drilled section of a borehole. Casing 110 may include a hollow channel, passageway, conduit extending from a proximal end of the casing 110 to a distal end of the casing 110. This passageway may allow fluid to flow through the casing 110. Casing 110 may include a cutout 112 and ledge 114.

Cutout 112 may be configured to increases the inner diameter across casing 110. This may allow temporary seal 120 to have a diameter that is larger than the inner diameter across casing 110 in positions above cutout 112. Ledge 114 may be positioned on a distal end of cutout 112, wherein ledge 114 may be an abutment that decreases the inner diameter across casing 110 to a length that is substantially similar to the inner diameter of casing 110 above cutout 112. In embodiments, annular space 156 may have length that is at least as long as that of sliding projection 130 and shearing element 150.

Temporary seal 120 may be a disc, or any object. Temporary seal 120 may be comprised of breakable materials, such as glass or it may be assembled from more than one piece. In the first position as shown in FIG. 1, temporary seal 120 may be positioned proximal to a first end of the cutout 112 on an upper surface of sliding projection 130, and extend across the inner diameter of casing 110. This may form a seal across casing 110, such that fluids, substances, etc. may not flow through casing 110. In embodiments, lower edges 122 of the temporary seal may be tapered or at any angle, and be positioned on an upper surface of sliding projection 130. The tapering or the angle of lower edges 122 may extend downward towards a central axis of casing 110, this may allow for compressive forces applied to the upper surface of temporary seal 120 to form a tighter closure with sliding projection 130.

Sliding projection 130 may be positioned adjacent to an inner diameter of casing 110 within cutout 112, and adjacent to shearing element 150. Sliding projection 130 may be configured to move along a longitudinal axis of casing 110 from a first end of cutout 112 when in the first position to be positioned on ledge 114 in a second position. An upper surface 132 of the sliding projection may include tapered sidewalls. The upper surface 132 of sliding projection 112 may be shaped to correspond with the lower edges 122 of temporary seal 122. An outcrop 134 may be positioned on sliding projection 120. Outcrop 134 may include tapered sidewalls that extend from a body of sliding projection 130 upward towards the central axis of casing 110, wherein outcrop may not vertically extend past ledge 114 or an inner diameter of shearing element 150.

Temporary coupling mechanisms 140 may be configured to temporarily couple sliding projection 130 with the shearing element 150. The temporary couple mechanisms 140 may be shear screws, or any other device that is configured to break or be removed once a predetermined amount of force is applied to the temporary coupling mechanisms 140.

Shearing element 150 may have a first end supported by ledge 114, wherein shearing element 150 is configured to be secured in place. Shearing element may also have an inner sidewall that is adjacent to the outer sidewall of sliding projection 130. An upper surface 152 of the shearing element may include a blade that is configured to pierce, shatter, break, etc. temporary seal 120 into multiple parts that can move towards the distal end of casing 110 responsive to the blade interacting with the temporary seal 120. In embodiments, the blade 152 may have an angle that is configured to correspond with an angle of the outcrop 134, wherein the blade 152 extends past the outcrop 134 when system 100 is in the second position.

Shearing element 150 may include a port 154 that is configured to equalize the pressure of the inner diameter of the casing 110 below temporary seal 120 and a chamber 156 positioned below the sliding projection 130. This may allow the sliding projection to more efficiently move within the chamber 156.

Figure 2:
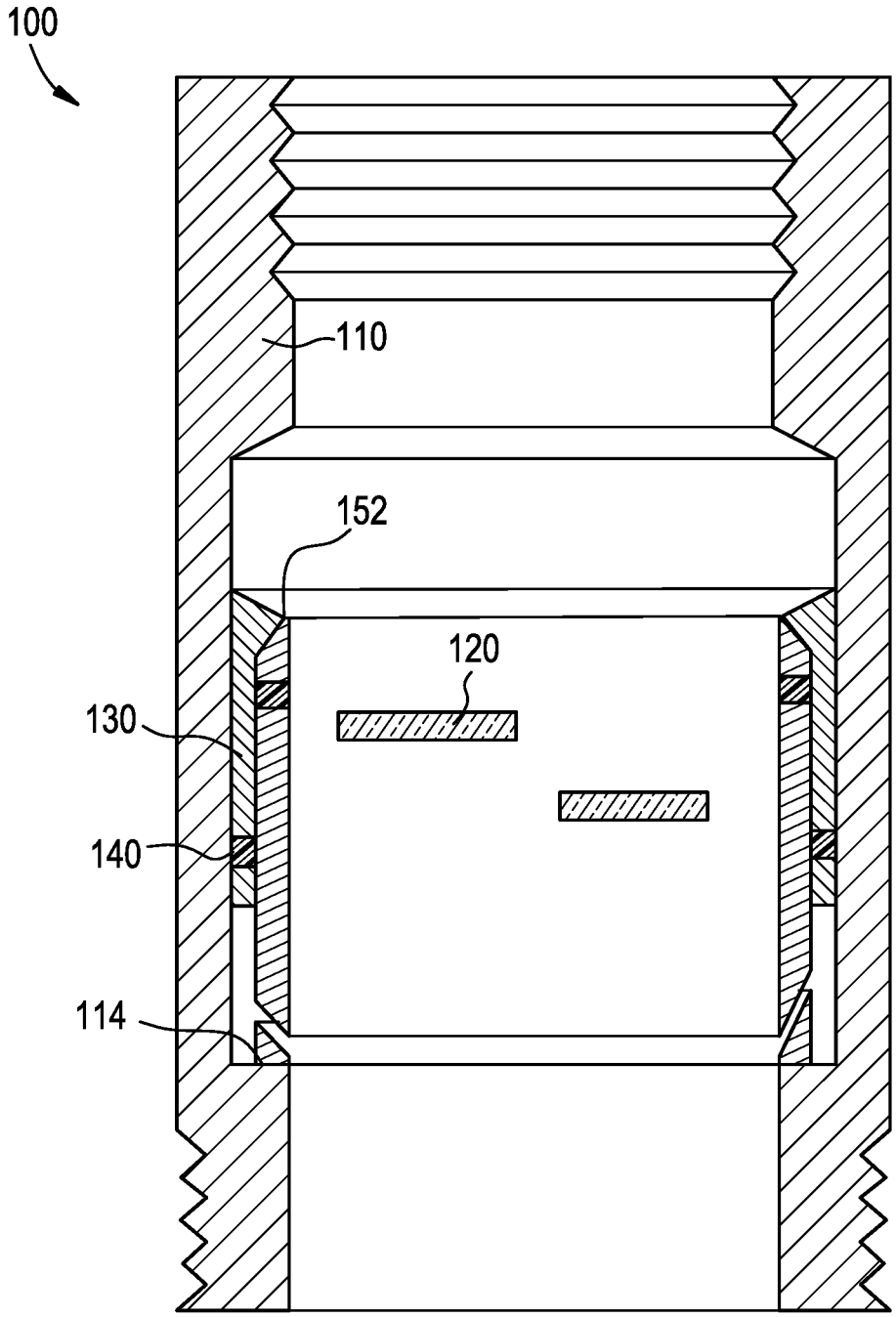
FIG. 2 depicts a system in the second position, according to an embodiment.

FIG. 2 depicts system 100 in the second position, according to an embodiment. Elements in FIG. 2 may be described above, but for the sake of brevity another description of these elements are omitted.

As depicted in FIG. 2, responsive to the pressure above temporary seal 120 in casing 110 being above a pressure threshold, temporary seal 120 may apply pressure against sliding projection 130 with sufficient force to shear, break, etc. temporary coupling mechanisms 140. This shearing of temporary coupling mechanism 140 may allow sliding projection 130 to move towards ledge 114.

Responsive to sliding projection 130 moving towards ledge 114, the force applied to temporary seal 120 may push temporary seal 120 towards blade 152 with sufficient force to break or disconnect the temporary seal 120 into multiple pieces. When temporary seal 120 is fragmented into multiple pieces, the seal across the inner diameter of casing 110 may be broken allowing fluid to flow through casing 110.

Figure 3:
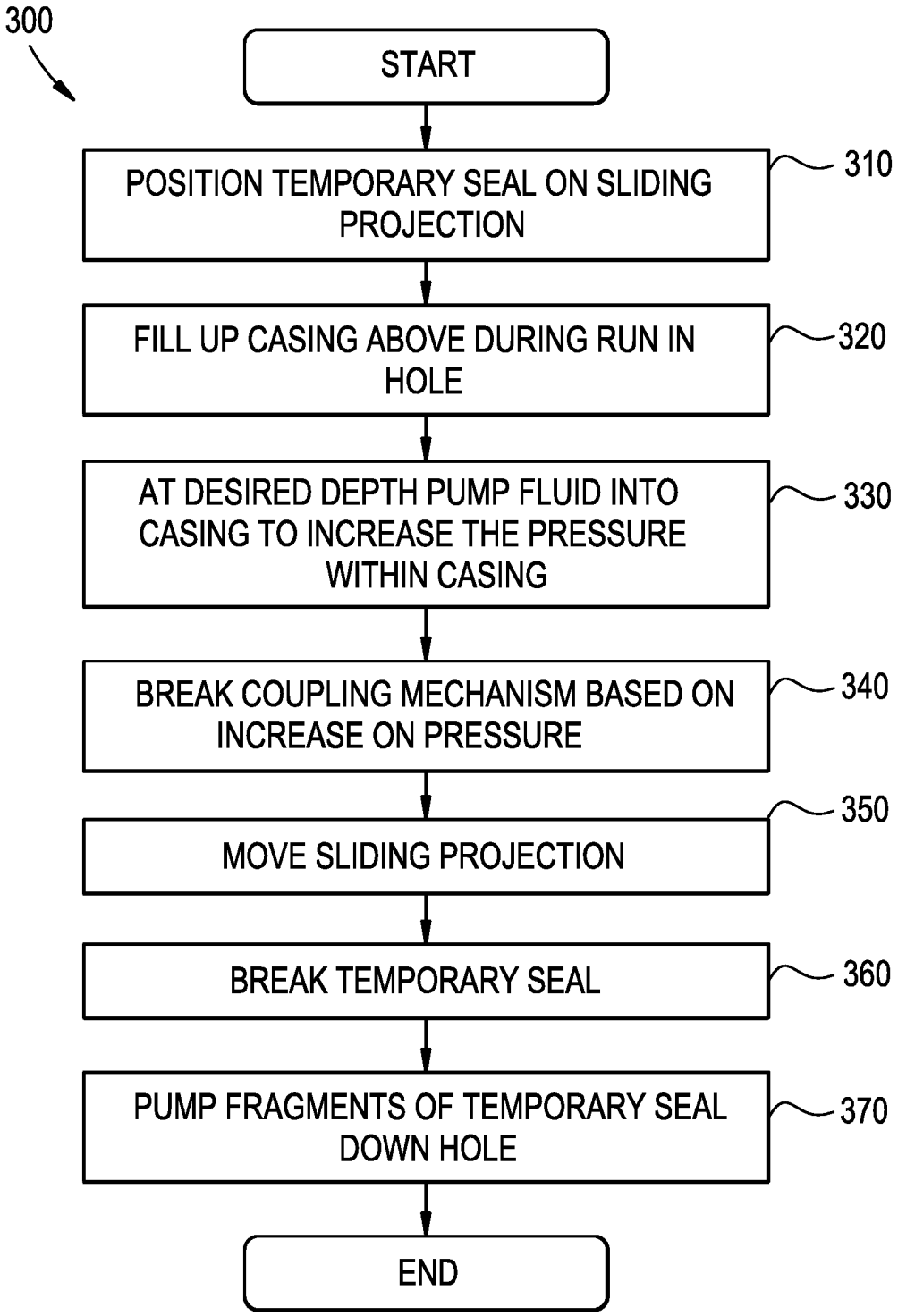
FIG. 3 depicts a method of utilizing a temporary seal across a casing in a wellbore, according to an embodiment.

FIG. 3 depicts a method 300 of utilizing a temporary seal across a casing in a wellbore, according to an embodiment. The operations of the method depicted in FIG. 3 are intended to be illustrative. In some embodiments, the method may be accomplished with one or more additional operations not described, and/or without one or more of the operations discussed. Additionally, the order in which the operations of the method are illustrated in FIG. 3 and described below is not intended to be limiting. Elements depicted in FIG. 3 may be described above. For the sake of brevity, a further description of these elements is omitted.

At operation 310, a temporary seal may be positioned on a sliding projection. The temporary seal may be positioned on the sliding projection before the casing is positioned in the wellbore, or the temporary seal may be dropped into the casing after the casing is positioned in the wellbore. The temporary seal may be positioned within a cutout within the casing, wherein the cutout has a larger first inner diameter than the second inner diameter associated with portions of the casing below and above the cutout. In embodiments, the temporary seal may have a third inner diameter that is greater in size than the second inner diameter and smaller than the first inner diameter.

At operation 320, portions of the casing above the temporary seal may be filled with fluid while the casing is being run in the hole. This may give portions of the casing below the temporary seal buoyancy and additional flexibility.

At operation 330, responsive to the casing reaching a desired depth, the fluid flow rate through the casing may be increased, wherein the fluid may flow into the casing from the proximal end of the casing towards the distal end of the casing. However, the fluid may not be able to flow through the casing due to the temporary seal forming a blockage. Due to the seal creating across the casing, the pressure above the temporary seal within the inner diameter of the casing may increase to be greater than a pressure threshold. This pressure may cause the temporary seal to apply forces against a sliding projection, and also hold the temporary seal against the sliding projection.

At operation 340, temporary coupling mechanisms that selectively couple the sliding projection and a shearing element may be broken based in part on the forces applied by the temporary seal against the sliding projection.

At operation 350, responsive to the temporary coupling mechanisms being broken, the sliding projection may move towards a distal end of the casing, wherein the temporary seal moves along with the sliding projection.

At operation 360, when the sliding projection moves a sufficient distance, a blade on a shearing element may interact with the temporary seal, shattering the temporary seal. In embodiments, pressure above the temporary seal created by the fluid may hold the temporary seal in place on the upper surface sliding projection while moving downward. The downward movement of the temporary seal coupled with the forces applied to the upper surface of the temporary seal via the fluid and the pressure applied to the lower surface of the temporary seal via the blade of the shearing element may be sufficient to shatter the temporary seal into a plurality of fragments. This may break the seal within the casing, and allow fluid to flow from the proximal end of the casing to the distal end of the casing.

At operation 370, the fragments may travel past the shearing element towards the distal end of the well. The fragments may later be collected within a downhole basket, filter, compartment, etc.

Figure 4:
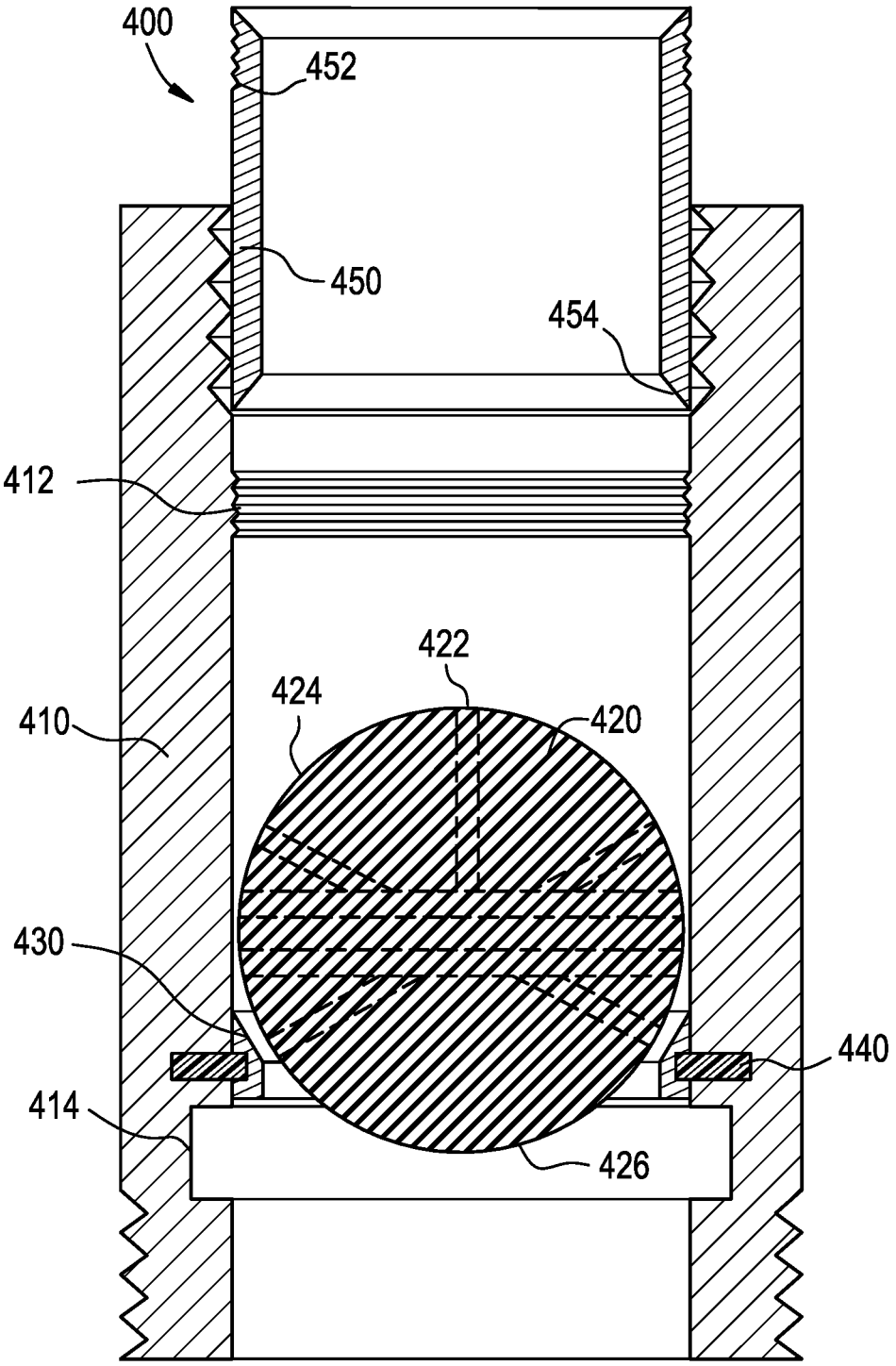
FIG. 4 depicts a system, in a first position, to temporarily seal casing within a wellbore, according to an embodiment.

FIG. 4 depicts a system 400, in a first position, to temporarily seal casing within a wellbore, according to an embodiment. Elements depicted in FIG. 4 may be descried above. For the sake of brevity, another description of those elements is omitted. System 400 may include casing 410, blocking element 420, adjustable or expandable seat 430, temporary coupling mechanisms 440, and holding element 450.

Casing 410 may have in inner diameter that includes first threads 412 and groove 414. Threads 412 may be configured to interface with second threads 452 on holding element 440 to allow holding element 450 to move in a direction that is in parallel to the longitudinal axis of casing 110. Threads 412 may be positioned closer to a proximal end of casing 110 than groove 414. Groove 414 may be a cutout, indentation, etc. positioned within casing 410. Groove 414 may increase the inner diameter of casing 110 from a first diameter to a second diameter, wherein the second diameter is greater than the first diameter. Groove 414 may be configured to receive adjustable or expandable seat 430 responsive to adjustable or expandable seat 430 being aligned within groove 414. This may enable adjustable or expandable seat 430 to expand.

Blocking element 420 may be a ball or any object that has a third diameter, wherein the third diameter is smaller than the first diameter of casing 110, and larger than a fourth diameter associated with adjustable or expandable seat 430. Blocking element 420 may be configured to sit on adjustable or expandable seat 430 in the first position and move through the casing in the second position. When blocking element 420 is positioned on adjustable or expandable seat 430, blocking element 420 may cover an orifice positioned through adjustable or expandable seat 430 causing a seal within casing 110. Responsive to blocking element passing through adjustable or expandable seat 430, the seal may no longer be formed through casing 110. Blocking element 420 may include a plurality of gun drilled holes 422. Holes 422 may be positioned on an upper portion of blocking element 420, wherein the upper portion of blocking element 420 is positioned above adjustable or expandable seat 430 when blocking element 420 is positioned on adjustable or expandable seat 430. Holes 422 may extend through a circumference, radius, chord, subsection, etc. of blocking element 420 and allow fluid to flow through blocking element 420 based on the positioning of blocking element 420, wherein the positioning of blocking element 420 may be controlled until blocking element 420 rests on adjustable or expandable seat 430. In embodiments, a lower portion 420 of blocking element may not have any holes 422. Accordingly, in this illustration the inner diameter of casing 110 above blocking element 420 is not in fluid communication with the inner diameter of casing below blocking element 420 when blocking element 420 is positioned on adjustable or expandable seat. However, the position of the blocking element can be reversed.

Adjustable or expandable seat 430 may be configured to secure blocking element 420 within the casing 110 in the first position, and allow blocking element 420 to pass through adjustable or expandable seat 430 in a second position. Adjustable or expandable seat 430 may be comprised of two semi-circles with a hollow center and an outer diameter. The outer diameter may be configured to conform to the materials positioned adjacent to the outer diameter, such that the outer diameter may expand or contract. This may cause the hollow center to correspondingly expand or contract, wherein the hollow center has a fourth diameter in the first position and a fifth diameter in the second position. In embodiments, the fourth diameter may be smaller than the third diameter of blocking element 420, such that blocking element 420 may sit on adjustable or expandable seat 430 in the first position and create isolated zones above and below adjustable or expandable seat 430. The fourth diameter may also be smaller than first diameter associated with casing 410, such that the adjustable or expandable seat 430 extends into the inner diameter of casing 410 in the first position. The fifth diameter may be greater than or equal to the first diameter, such that blocking element 420 may pass through the hollow center in the second position. In the first position, adjustable or expandable seat 430 may be coupled to casing 410 via temporary coupling mechanisms 440. In the second position, adjustable or expandable seat 430 may be decoupled from temporary coupling mechanisms 440, and slide into groove 414 within casing. Responsive to adjustable or expandable seat 430 being positioned in groove 414, the inner diameter may increase from the fourth diameter to the fifth diameter.

Temporary coupling mechanisms 440 may be configured to temporary couple the adjustable or expandable seat 430 with the casing 110. Temporary coupling mechanisms 440 may be shear screws, or any other device that is configured to break, shear or be removed once a predetermined amount of pressure or force is applied to temporary coupling mechanisms 440, wherein the force may be applied by blocking element 420 against adjustable or expandable seat 430 and/or the pressure within the inner diameter of casing 110 above blocking element 420. Responsive to breaking the temporary coupling mechanisms 440, the adjustable or expandable seat 430 may move from the first position to the second position.

Holding element 450 may be a device that is configured to be positioned adjacent to the inner sidewalls of the casing 110. Holding element 450 may include threads 452 that are configured to interface with the threads 412 on the casing 110. Threads 452 may be configured to allow holding element 450 to be coupled with casing 110 and move in a direction in parallel to the longitudinal axis of casing 110. Utilizing the threads, holding element 450 may move towards the distal end of casing 110, allowing a distal end 454 of holding element 450 to apply forces against blocking element 420. Accordingly, in the first position, a lower portion 426 of blocking element 420 may be held in place via the adjustable or expandable seat 430, and an upper portion 424 of blocking element 420 may be held in place via holding element 450. In embodiments, the distal end 454 of holding element may include a tapered, angled, or curved sidewall, which may be tapered or curved downward and away from the center axis of casing 410. The shape of distal end 545 may be utilized to apply pressure to different layers of blocking element 420 to move effectively secure blocking element 420 in place.

Figure 5:
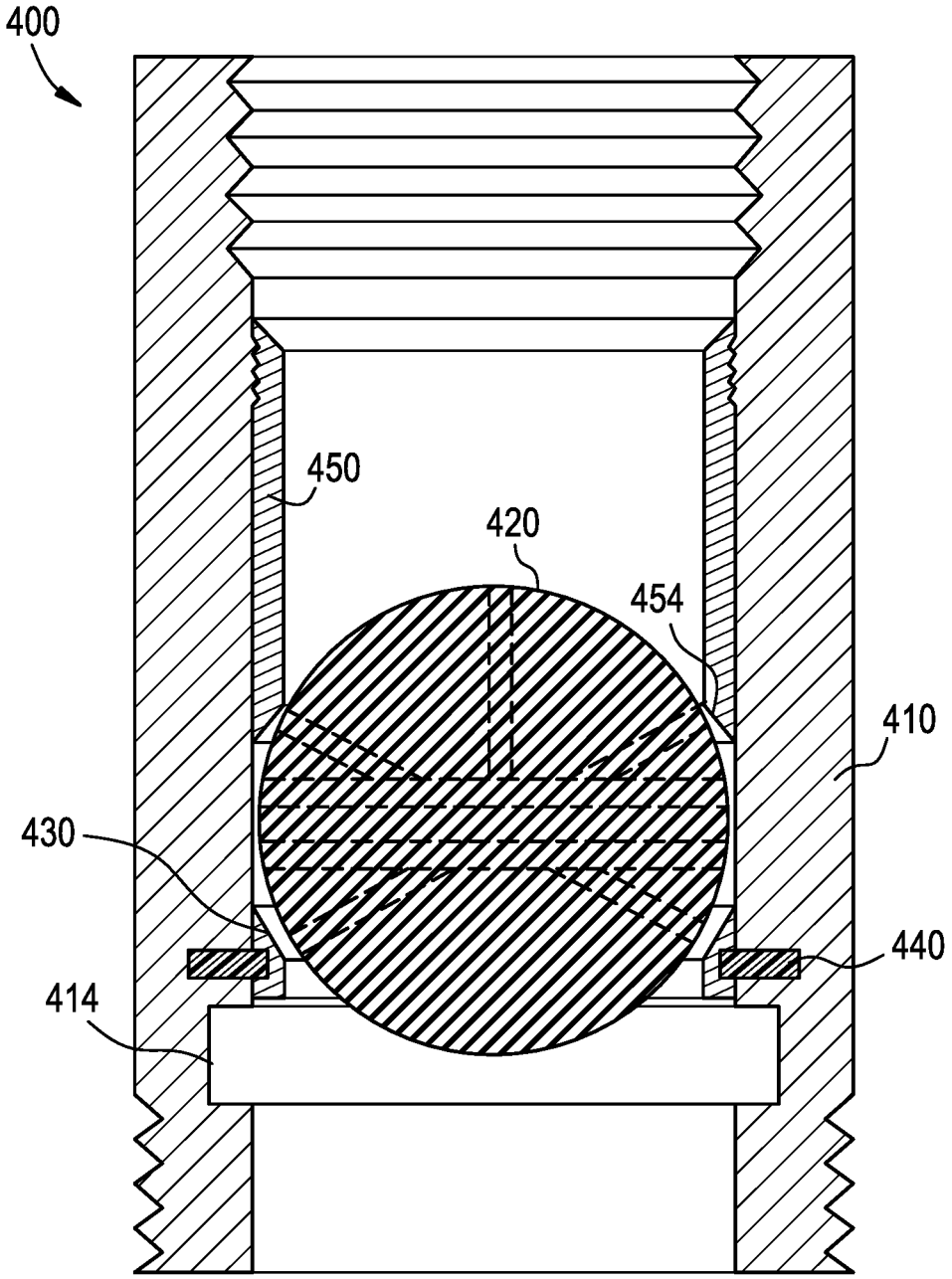
FIG. 5 depicts a system, in a first position, to temporarily seal casing within a wellbore, according to an embodiment.

FIG. 5 depicts a system 400, in a first position, to temporarily seal casing within a wellbore, according to an embodiment. Elements depicted in FIG. 5 may be descried above. For the sake of brevity, another description of those elements is omitted.

As depicted in FIG. 5, holding element 450 may be lowered by rotating holding element 450 via the threads. This may allow the distal end of holding element 454 to apply pressure against the outer surface of blocking element 420 to secure blocking element 430 in place.

Responsive to blocking element 420 being secured in place, fluid may flow through the inner diameter of casing 410. However, due to the seal caused by blocking element 420 and adjustable or expandable seat 430, a pressure above blocking element 420 within casing 110 may increase. This increase in pressure may cause temporary couple mechanisms 440 to break, allowing blocking element 420 and adjustable or expandable seat 430 to move.

Figure 6:
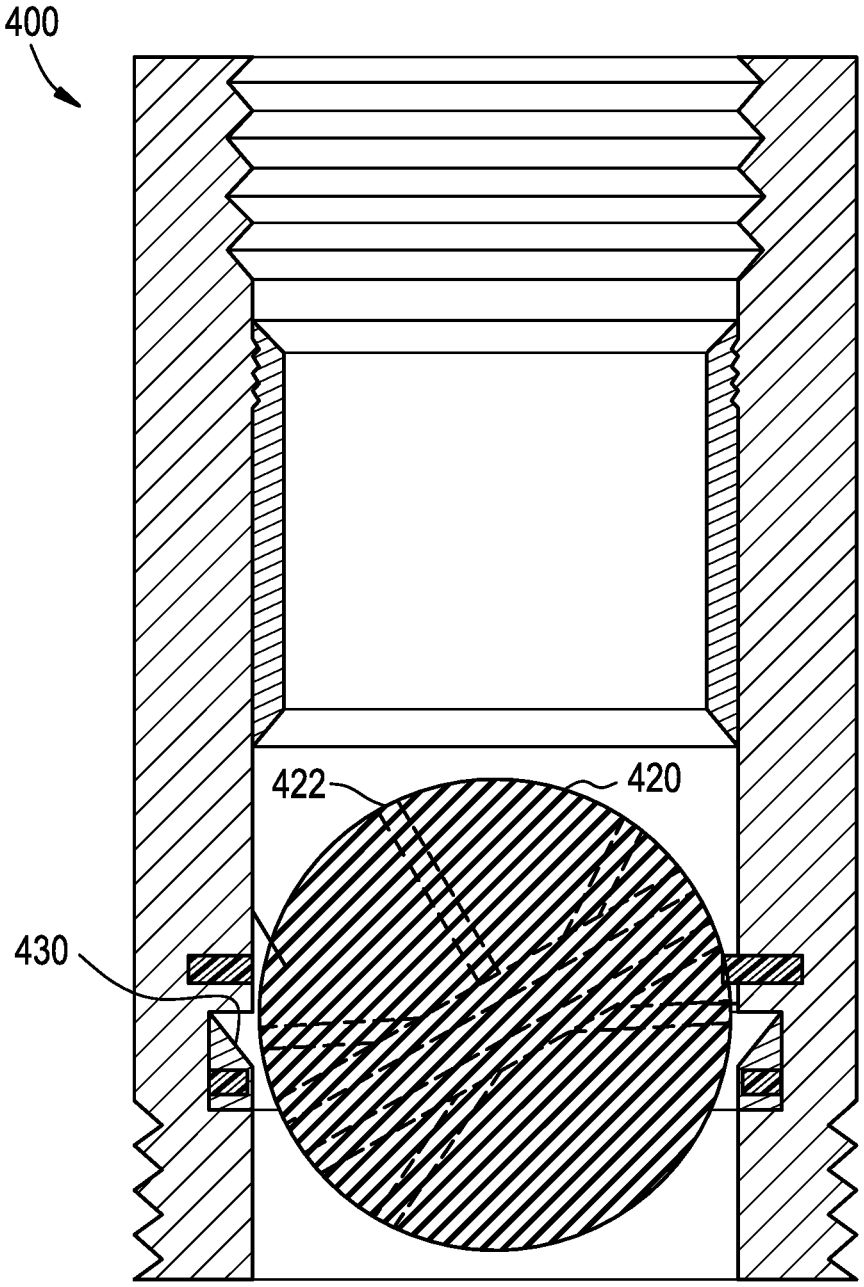
FIG. 6 depicts a system, in a second position, according to an embodiment.

FIG. 6 depicts a system 400, in a second position, according to an embodiment. Elements depicted in FIG. 6 may be descried above. For the sake of brevity, another description of those elements is omitted.

As depicted in FIG. 6, adjustable or expandable seat 430 may be positioned within groove 414. This may allow the outer diameter of adjustable or expandable seat 430 to expand to the second diameter, and the inner diameter of adjustable or expandable seat 430 to expand from the fourth diameter to the fifth diameter. When the inner diameter of adjustable or expandable seat 430 expands, blocking element 420 may move towards the distal end of casing 410, and no longer form a seal across casing 410. Furthermore, as blocking element 422 moves through casing 410, fluid may flow through blocking element 420 via holes 422.

Figure 7:
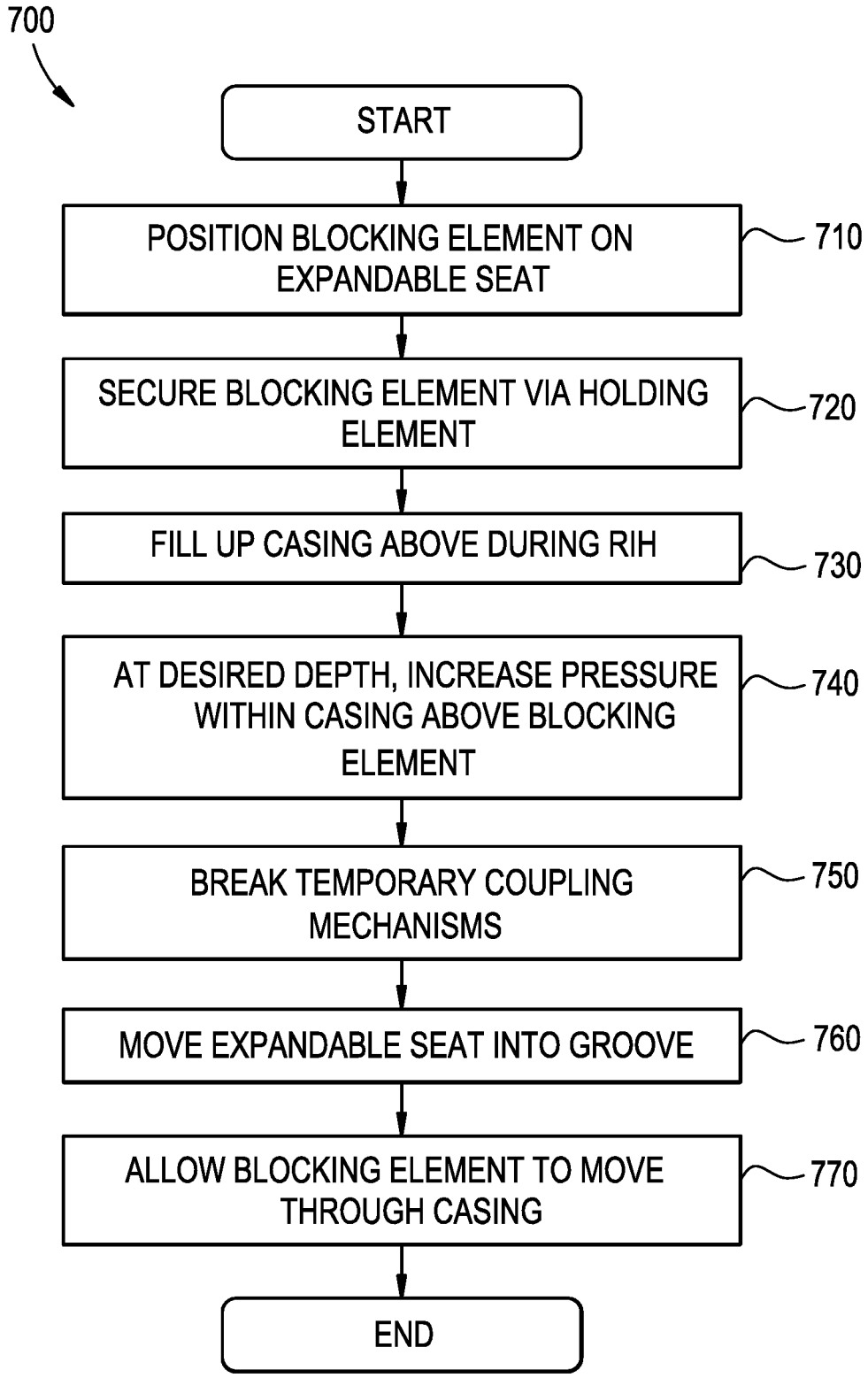
FIG. 7 depicts a method of utilizing a temporary seal across a casing in a wellbore, according to an embodiment.

FIG. 7 depicts a method 700 of utilizing a temporary seal across a casing in a wellbore, according to an embodiment. The operations of the method depicted in FIG. 7 are intended to be illustrative. In some embodiments, the method may be accomplished with one or more additional operations not described, and/or without one or more of the operations discussed. Additionally, the order in which the operations of the method are illustrated in FIG. 7 and described below is not intended to be limiting. Elements depicted in FIG. 7 may be described above. For the sake of brevity, a further description of these elements is omitted.

At operation 710, a blocking element may be positioned on an adjustable or expandable seat. The blocking element may be configured to partition a first portion of casing above the blocking element from a second portion of casing below the blocking element.

At operation 720, the blocking element may be secured in place via a holding element applying forces against an upper portion of the blocking element. Responsive to the blocking element being secured in place, a seal may be created between the first and second portions of casing.

At operation 730, portions of the casing above the blocking element may be filled with fluid while the casing is being run in the hole. This may give portions of the casing below buoyancy and additional flexibility.

At operation 740, additional fluid may flow into the casing from the first portion of the casing towards the second portion of the casing. Due to the seal within the casing, the pressure within the first portion may increase.

At operation 750, responsive to the pressure within the first portion of the casing increasing past a pressure threshold, temporary coupling mechanisms coupling the adjustable or expandable seat to the casing may break.

At operation 760, when the temporary coupling mechanisms break, the adjustable or expandable seat may become aligned with a groove, and move into the groove positioned below its initial position. Responsive to the adjustable or expandable seat being positioned within the groove, a hollow inner diameter of the adjustable or expandable seat may increase.

At operation 770, when the inner diameter of the adjustable or expandable seat increases past a diameter of the blocking element, the blocking element may move past the groove towards a distal end of the casing. This may eliminate the seal within the casing.

Figures 8, 9, 10:
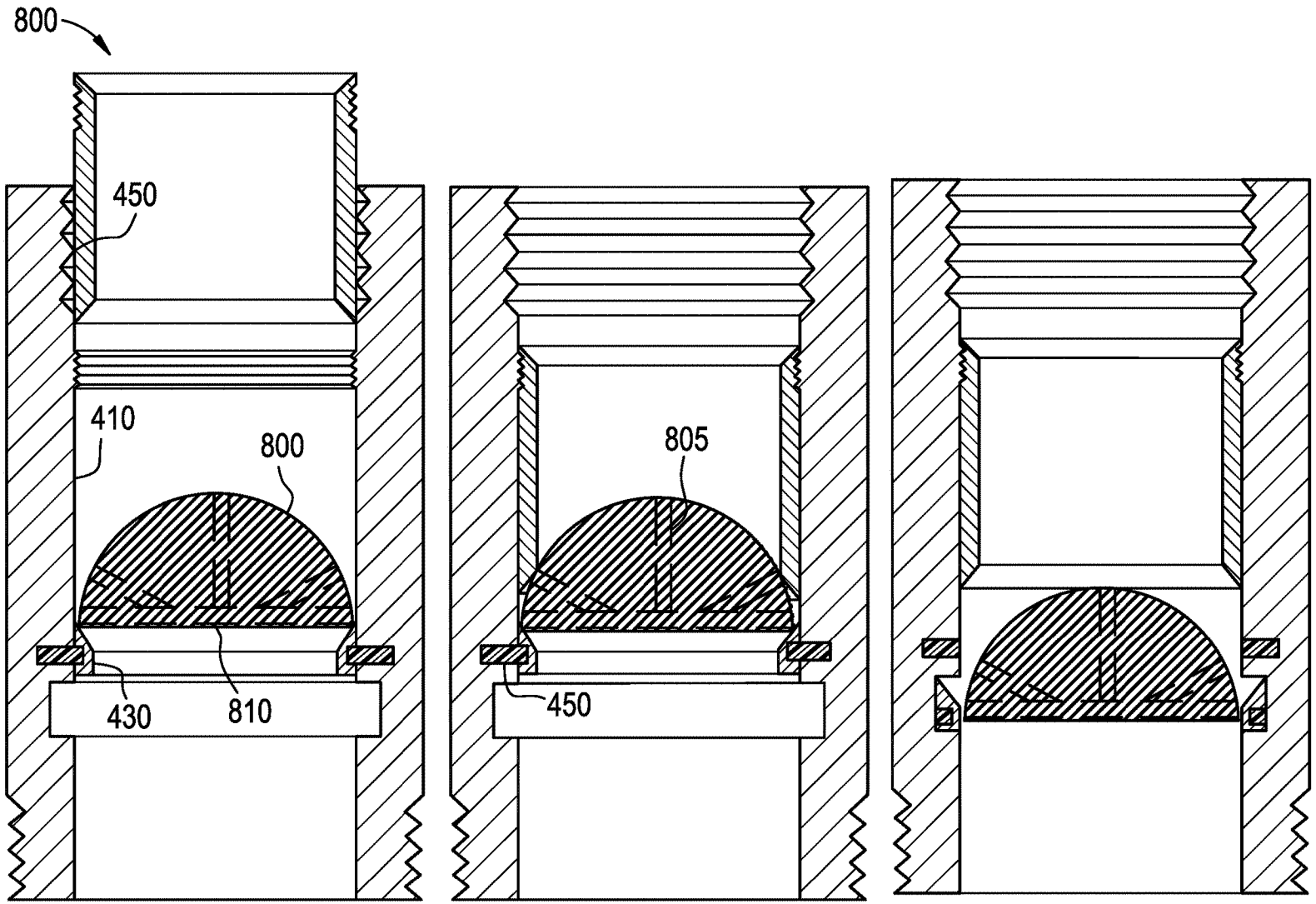
FIGS. 8-10 depicts a system, to temporary form a seal within a casing, according to an embodiment.

FIGS. 8-10 depicts a system 800, to temporary form a seal within a casing, according to an embodiment. Elements depicted in FIG. 8-10 may be descried above. For the sake of brevity, another description of those elements is omitted.

System 800 depicts that any geometric shaped element can be utilized as a blocking element 800, such as a half circle, to form a seal between an upper portion of casing 410 and a lower portion of casing 410. As depicted in FIGS. 8-10, blocking element 800 may include gun drilled holes 805. However, holes 805 may not extend into a lower surface 810 of blocking element, such that the upper portion and lower portion of casing 410 are not in fluid communication.

Figure 11:
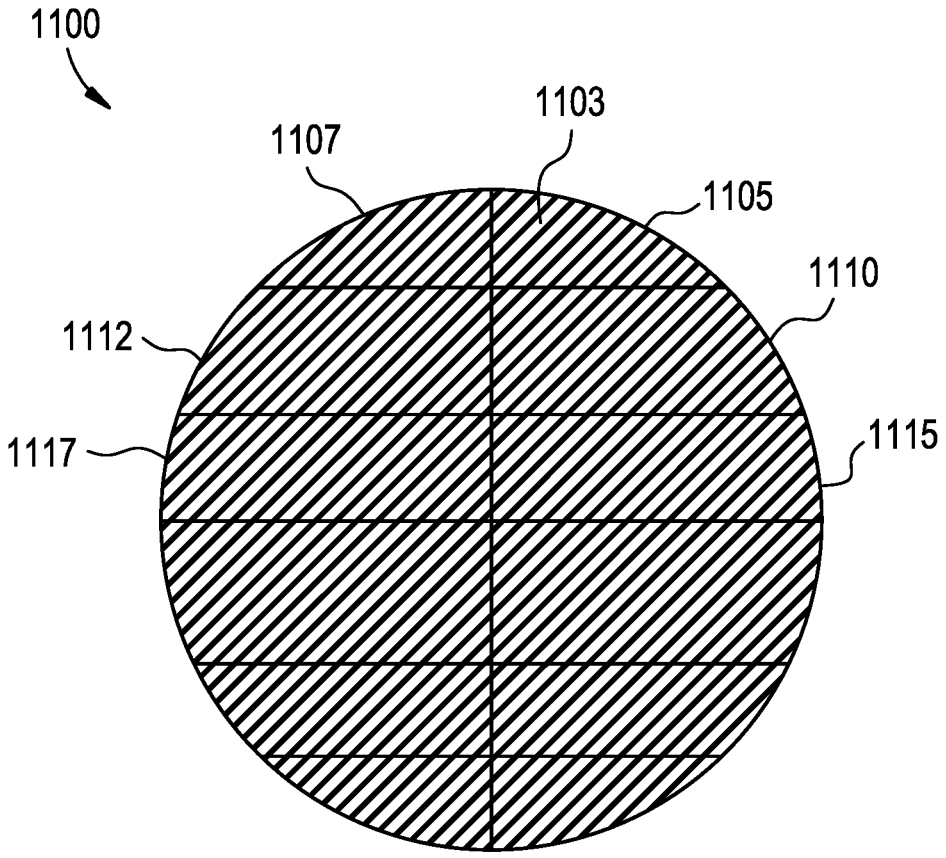
FIG. 11 depicts a blocking element, according to an embodiment.

FIG. 11 depicts a blocking element 1100, according to an embodiment. As depicted in FIG. 11, blocking element 110 may be comprised of multiple layers 1105, 1110, 1115, wherein the different layers 1105, 1110, 1115 may be comprised of different materials than the adjacent layers. In embodiments, the layers 1105, 1110, 1115 may be coupled together via any known means, including adhesives, welding, joints, or be assembled next to each other's etc.

In further embodiments, each layer 1105, 1110, 1115 may be comprised of different segments 1107, 1112, and 1117, respectively. This may allow each layer 1105, 1110, and 1115 to be formed of different materials, wherein a first segment 1103 in a layer 1105 is formed of a first material and a second segment 1107 in the layer 1105 is formed of a second material In embodiments, a first layer 1105 and a third layer 1115 may be comprised of a ridge material, such as metal, composites or hard plastics. A second layer 1110 may be comprised of compressible materials, such as rubber. The second layer 1110 may be configured to be aligned with the movement of a sliding projection 450. Responsive to the sliding projection 450 moving downward, a distal end of sliding projection 450 may be aligned with second layer 1110, and indent and compress second layer 1110. By forming layers of blocking 1100 of different layers based on the layers alignment with sliding projection 450 when blocking element is positioned on an adjustable or expandable seat 430, the clamping force generated by sliding projection 450 may be increased.

Figure 12:
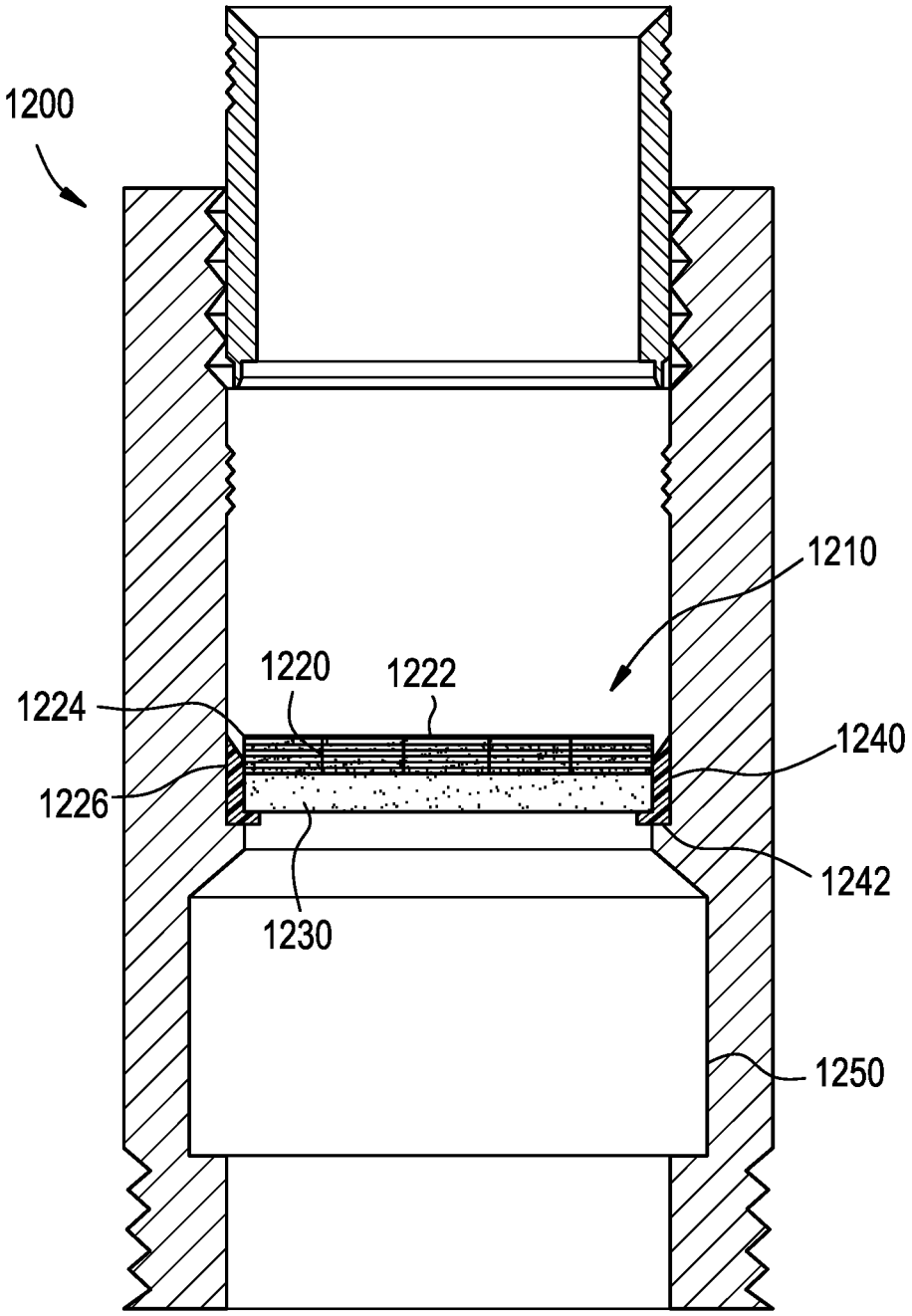
FIG. 12 depicts a temporary sealing system, according to an embodiment.

FIG. 12 depicts a temporary sealing system 1200, according to an embodiment. Elements depicted in FIG. 12 may be described above. For the sake of brevity, another description of these elements is omitted.

Sealing system 1200 may include a temporary seal 1210, shearing seat 1240, and chamber 1250.

Temporary seal 1210 may be a single or multi-layered device that is configured to temporary seal a casing, tool, etc. positioned within a wellbore. Temporary seal 1210 may configured to seal a plane that is positioned perpendicular to a central axis of the wellbore, which may atmospherically isolate areas above and below the seal. In embodiments, temporary seal 1210 may be configured to temporarily be positioned on shearing seat 1240. Temporary seal 1210 may be comprised of multiple layers including, at least, upper layer 1220 and lower layer 1230, which may be dissolvable layers.

Upper layer 1220 may be configured to be positioned on layer 1230, such that dissolvable layer 1220 covers a first face of layer 1230. Upper layer 1220 and 1230 may be comprised of dissolvable or disintegrating material that configured to dissolve or disintegrate over a given time period, interaction with fluids or the environment, a combination etc. For example, the segments within upper layer 1220 and 1230 may be formed of dissolvable rubber, strips, magnesium, aluminum, dissolvable steel etc. In embodiments, the segments within upper layer 1220 and 1230 may be configured to dissolve at a given rate based in part on the surface area of the segments exposed to hydraulic fluid. Upper layer 1220 may include a coating 1222 to protect the segments from pre-mature dissolving or breaking. The segments forming upper layer 1220 may be independent and unitary pieces that are not directly coupled to one another.

Coating 1222 may be formed of any chemical or coating that is configured to provide a sealant or to prevent a chemical reaction with the segments within segmented layers 1220 with hydraulic fluid. This may prevent first layer 1224 from dissolving if only the top surface of first layer 1224 interacts with the fluid. In further embodiments, coating 1222 may be provided on top surface of first layer 122 and a lower surface of the bottom layer of the segmented layers 1220 or breakable layer 1230. This may limit the interactions of fluids and the layers within upper layer 1220 until shearing seat 1240 is sheared. However, other than the top surface of first layer 1224 and the lower surface of the bottom layer being coated with coating 1222, the other surfaces may allow the segments within upper layer 1220 to dissolve when interacting with the fluid.

First layer 1224 may be a top layer of upper layer 1220 that has a first surface that is configured to be coated with coating 1222. However, a second surface of first layer may not be covered with coating 1222, which may allow first layer 1224 to dissolve when the second surface and/or sidewalls interact with hydraulic fluid. First layer 1224 may be comprised of a plurality of segments that are positioned adjacent to each other. When positioned adjacent to each other, the segments may be engaged with each other to form a temporary seal across a first plane that is perpendicular to a central axis of a wellbore. By positioning the plurality of segments adjacent to each other they may form a segmented geometrical shape, such as a cylinder that substantially blocks the inner diameter of the wellbore. However, the geometric shape formed by the plurality of segments may have an inner diameter that is equal or less than that of the casing or tool aligned with first layer 1224. In some other embodiments, an upper and/or lower surface of first layer 1124 may be formed from a complete disc that may be hatched, scared, scratched, scuffed etc. By hatching a surface of first layer 1124, a surface area of first layer 1124 may increase. This increased surface area may create a breaking point where a height of first layer 1124 is shorter and also increase a dissolving rate of first layer 1224.

Second layer 1226 may be a second layer of upper layer 1220 that is positioned beneath first layer 1224. In embodiments, neither an upper or lower surface of second layer 1226 may be covered by coating 1222. This may enable more surface area of second layer 1226 to interact with fluid than a surface area associated with first layer 1224 that can interact with fluid. Accordingly, the may enable second layer 1226 and first layer 1224 to dissolve at different rates, wherein second layer 1226 may dissolve quicker than first layer 1224. Second layer 1226 may be comprised of a plurality of segments that are positioned adjacent to each other to form a temporary seal across a second plane that is perpendicular to a central axis of the wellbore. In embodiments, each of the plurality of segments in first layer 1224 may have the same layout, shape, and size of corresponding segments in the second layer 1226, such that the layers are identical to each other in shape and layout. In other embodiments, the plurality of segments in first layer 1224 and second layer 1226 may have different shape, sizes, and/or layouts, which both forming the same and/or different geometric shape. For example, the segments in first layer 1224 and second layer 1226 may be arranged in a parallel manner, or be arranged in a crisscross manner. Furthermore, the segments in first layer 1224 and/or second layer 1226 may have the same or different thicknesses or width.

Lower layer 1230 may be positioned below upper layer 1220 and be configured to be positioned on shearing seat 1240, In embodiments, a first surface of lower layer 1230 may be covered by upper layer 1220, the sidewalls of lower layer 1230 may be covered by shearing seat 1240, and the bottom surface of breakable layer 1230 may be exposed to the air, light, fluid, and other elements in the wellbore. Lower layer 1230 may be comprised of a material that is configured to dissolve responsive to interacting with hydraulic fluid above layer 1224. Lower layer 1230 may be formed of a uniform part that is configured to extend across an inner diameter of the casing in a third plane that is positioned perpendicular to the central axis of the wellbore. Lower layer 1230 may have the same and/or different thickness to that of upper layer 1220. Furthermore, lower layer 1230 may be comprised of the same material as that as the segments in upper layer 1220 or a different material.

Shearing seat 1240 may be a shearable mechanism that is configured to shear, dissolve, disintegrate, expand or yield responsive to a pressure within the inner diameter of a tool or casing above shearing seat 1240 is greater than a shear threshold.

Shearing seat 1240 may be configured to secure temporary seal 1210 in place before being sheared, and allow temporary seal 1210 to move within the wellbore after being sheared. Shearing seat 1240 may include sidewalls that are configured to encompass portions of the side sidewalls of lower layer 1230 and portions of the sidewalls of upper layer 1220. However, in other embodiments shearing seat 1240 may include sidewalls that are configured to encompass side walls of all dissolvable layers. Shearing seat 1240 may also include a projection that is configured to abut towards a central axis of the wellbore and cover portions of the lower surface of dissolvable member 1230. Shearing seat 1240 may be coupled to the tool, a sleeve, etc. through a coupling mechanism such as a thread or may be configured to sit on a ledge 1242 positioned within the tool. In embodiments, an inner diameter across the tool aligned with ledge 1242 may be equal to or larger than that of a drift inner diameter of the tubular it is run in to prevent any restrictions if temporary seal 1210 does not shear shearing seat 1240.

Chamber 1250 may be positioned closer to a distal end of the tool than temporary seal 1210 and shearing seat 1240. An inner diameter within the tool aligned with chamber 1250 may be greater than an inner diameter above temporary seal 1210. Due to the change in size of the inner diameter within chamber 1250 turbulence, eddies, etc. may be created within chamber 1250 responsive to shearing seat 1240 shearing. This turbulence created may cause fluid within chamber 1250 to more rapidly interact with multiple surfaces of the segments within segmented layer 1210 and dissolvable layer 1220 and 1230. Furthermore, the turbulence created within chamber 1250 may allow the segments in segmented layer 1210 to disengage from each other, such that the segments are no longer positioned adjacent to each other. This may expose more surface area of each individual segment, allowing the segments to dissolve quicker.

Figure 13:
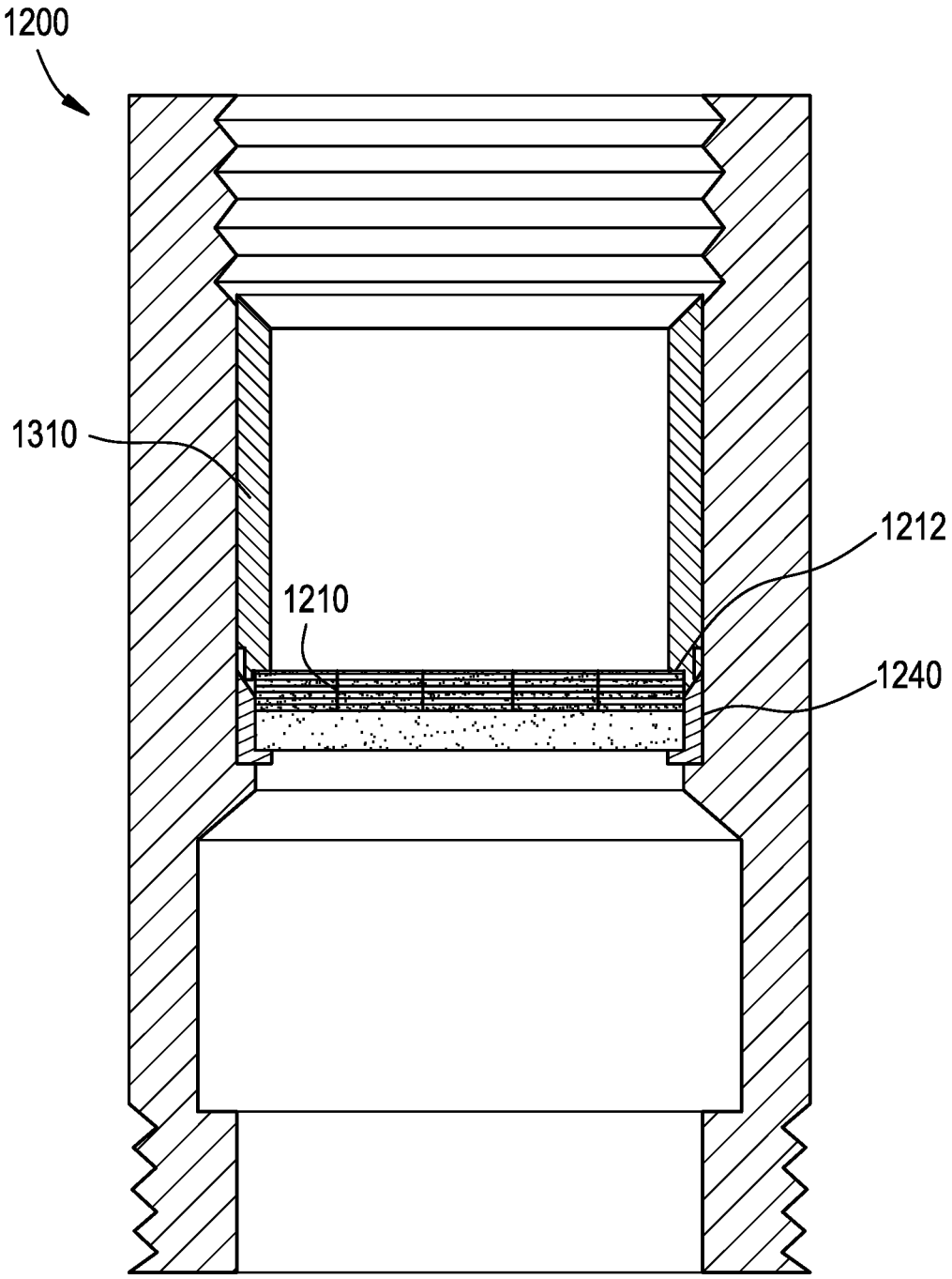
FIG. 13 depicts a temporary sealing system, according to an embodiment.

FIG. 13 depicts a temporary sealing system 1200, according to an embodiment. Elements depicted in FIG. 13 may be described above. For the sake of brevity, another description of these elements is omitted.

As depicted in FIG. 13, system 1200 may also include a holding element 1310. Holding element 1310 may be secured to an inner sidewall of the tool via threads, which allow holding element 1310 to move in a direction that is in parallel to the central axis of the wellbore. A distal end of holding element 1310 may include an overhand 1312. Overhang 1312 may be configured to increase a surface area of holding element 1310 that interfaces with an upper surface of upper layer 1220. In embodiments, responsive to moving holding element 1310 towards a distal end of the tool, holding element 1310 and/or shearing seat 1240 may apply compressive forces against temporary seal 1210. The compressive forces may be configured to restrict the lateral and longitudinal movements of the individual segments within each segmented layer. Responsive to shearing seat 1240 being sheared, the compressive forces may no longer be applied to temporary seal 1210, allowing the segments to disengage from one another.

Figure 14:
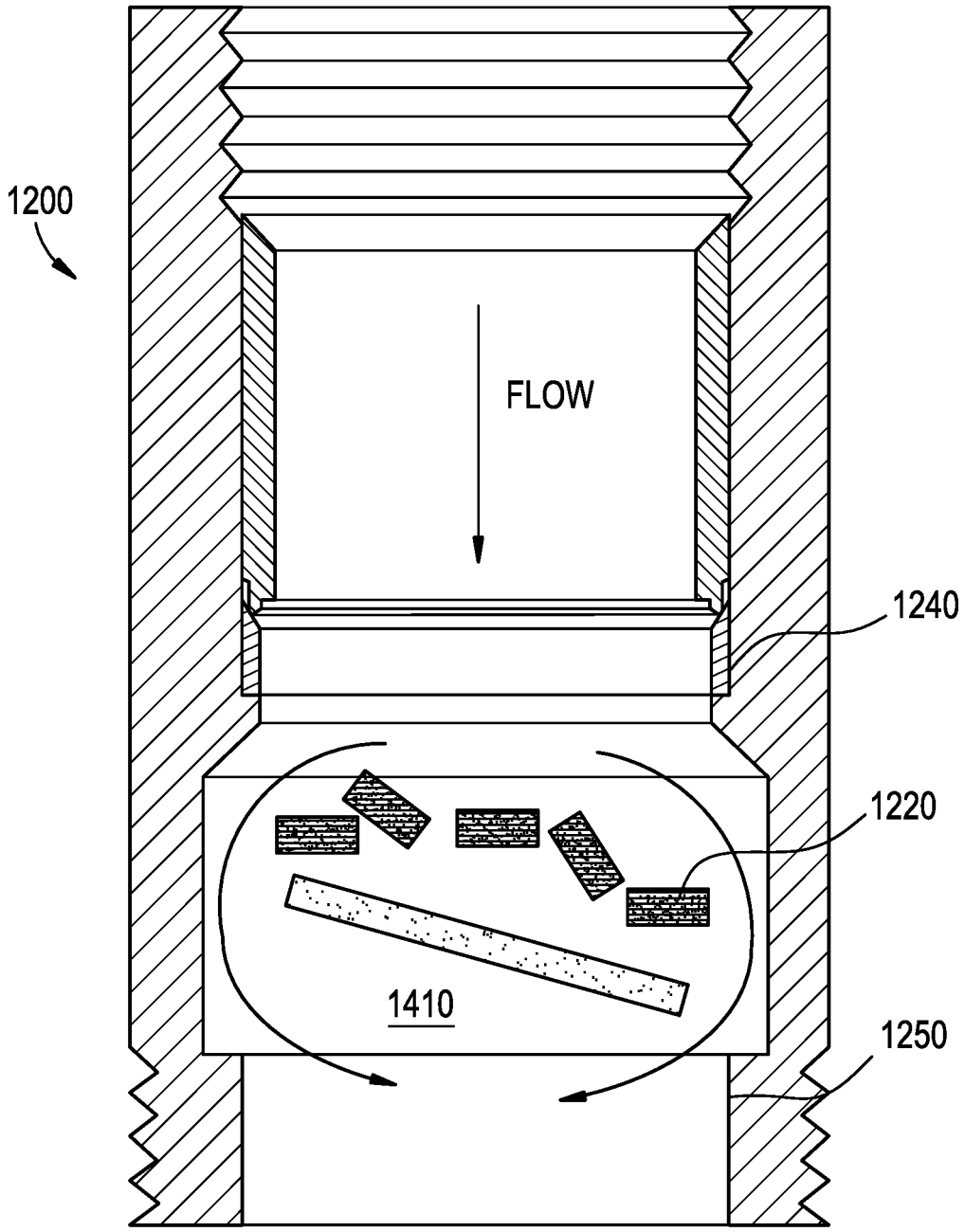
FIG. 14-15 depict a temporary sealing system, according to an embodiment.
Figure 15:
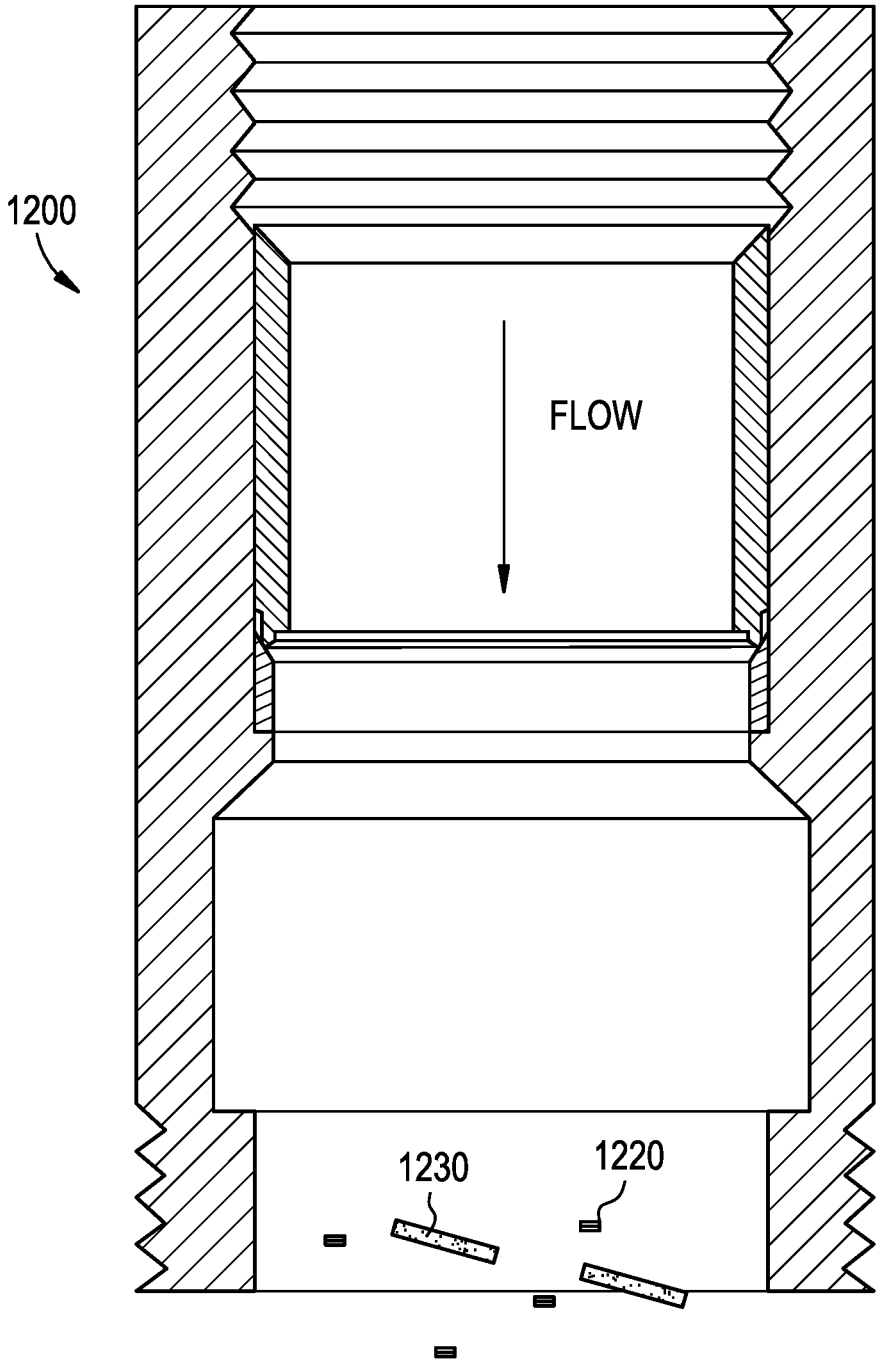

FIG. 14-15 depict a temporary sealing system 1200, according to an embodiment. Elements depicted in FIGS. 14-15 may be described above. For the sake of brevity, another description of these elements is omitted.

As depicted in FIG. 14, responsive to fluid flowing through the inner diameter of the tool, a pressure above shearing seat 1240 may be greater than a shearing threshold. This may cause shearing seat 1240 to shear, yield or expand, and allow temporary seal 1210 to be positioned within chamber 1250, and interact with the turbulence 1410. This may allow the segments within upper layer 1220 to become disengaged from each other, increasing the surface area of the segments exposed to the fluid.

As depicted in FIG. 15, as the fluid flow interacts with temporary seal 1210 within chamber 1250, shearing seat 1240, dissolvable, disintegrated and upper layer 1220 and lower layer 1230 may fragment into smaller pieces and travel downwell.

Figure 16:
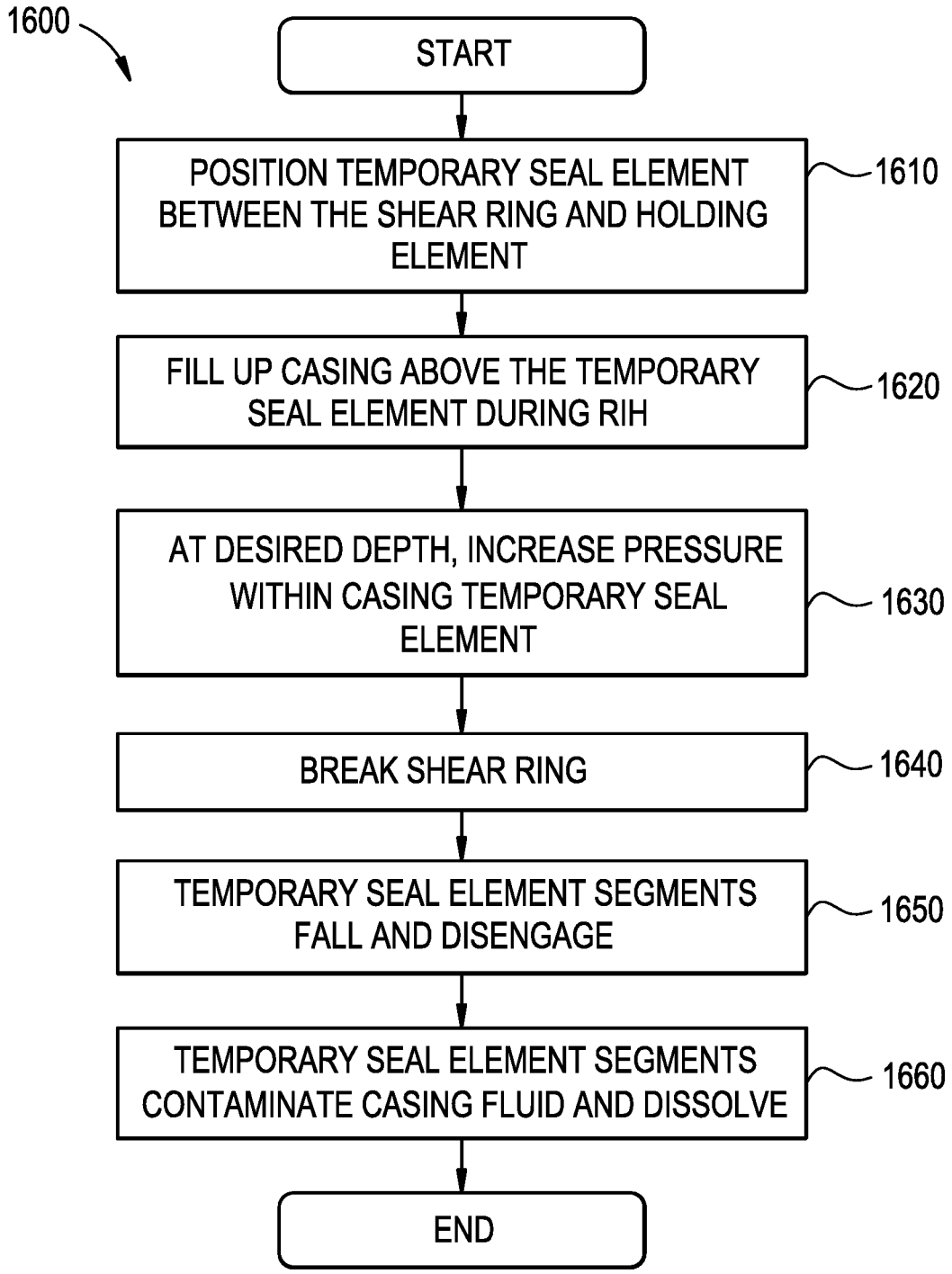
FIG. 16 depicts a method 1600 of utilizing a temporary seal across a casing in a wellbore, according to an embodiment.

FIG. 16 depicts a method 1600 of utilizing a temporary seal across a casing in a wellbore, according to an embodiment. The operations of the method depicted in FIG. 16 are intended to be illustrative. In some embodiments, the method may be accomplished with one or more additional operations not described, and/or without one or more of the operations discussed. Additionally, the order in which the operations of the method are illustrated in FIG. 16 and described below is not intended to be limiting. Elements depicted in FIG. 16 may be described above. For the sake of brevity, a further description of these elements is omitted.

At operation 1610, a temporary seal may be positioned between a shear ring and a holding element. In embodiments, the temporary seal may be comprised of a plurality of dissolvable segments that are positioned adjacent to each other.

At operation 1620, portions of casing above the temporary seal may be filled with fluid while the casing is being run in the hole. This may give portions of the casing below the temporary seal buoyancy and additional flexibility.

At operation 1630, additional fluid may flow into the casing from a proximal end of the casing towards the distal end of the casing. Due to the temporary seal within the casing, the pressure within the portion of casing above the temporary seal may increase.

At operation 1640, the increase in pressure above the temporary seal may cause the shear ring, supporting the temporary seal, to break.

At operation 1650, the segments associated with the temporary seal may separate from each other at a position below the shear ring. This may increase a surface area of each individual segment exposed to fluid within the casing.

At operation 1650, the segments may interact with the fluid causing the segments to dissolve and move towards the distal end of the casing.

Figure 17A:
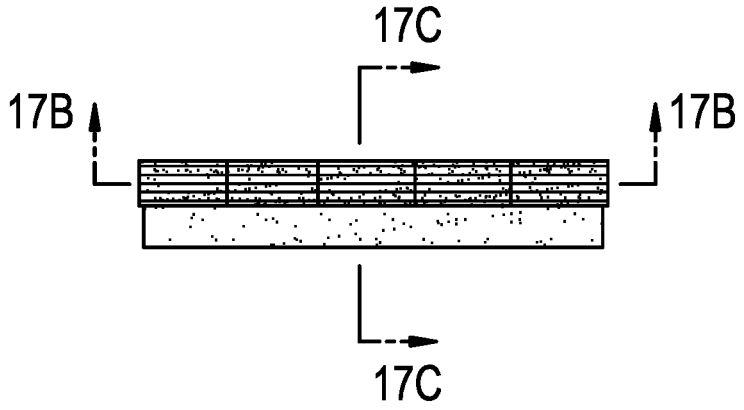
FIGS. 17A-C depicts an example of how the various segmented layers may be arranged, according to an embodiment.
Figure 17B:
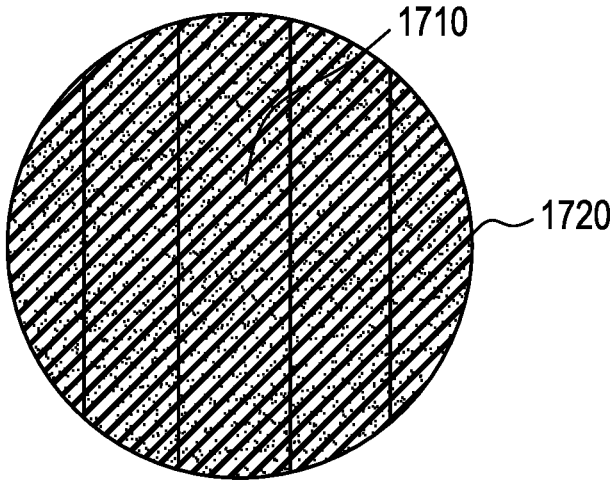
Figure 17C:
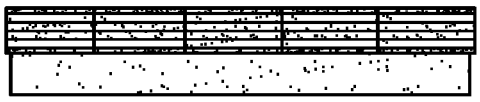

FIGS. 17A-C depicts an example of how the various segmented layers in layer 1220 and 1230 may be arranged relative to each other. Additionally, the order in which the operations of the method are illustrated in FIGS. 17-A-C and described below is not intended to be limiting.

As depicted in FIG. 17B, the first layer of temporary seal may include a plurality of segments 1710, 1720 that are positioned adjacent to each other in the same plane. This may allow the overall surface are of the segments of in a single layer to be a first amount when the segments are positioned adjacent to each other, and a second amount when the segments are disengaged from each other. The second amount may be greater than the first amount, which may allow the individual segments to more surface area to interact with the fluid leading to a faster dissolving rate after disengagement.

As depicted in FIG. 17C, an upper layer and a lower layer of the temporary seal may be formed with a different number of segments. For example, the upper layer may include a plurality of layers with each layer having a plurality of segments. The lower lower may be formed of a single layer having a single segment.

Figure 18:
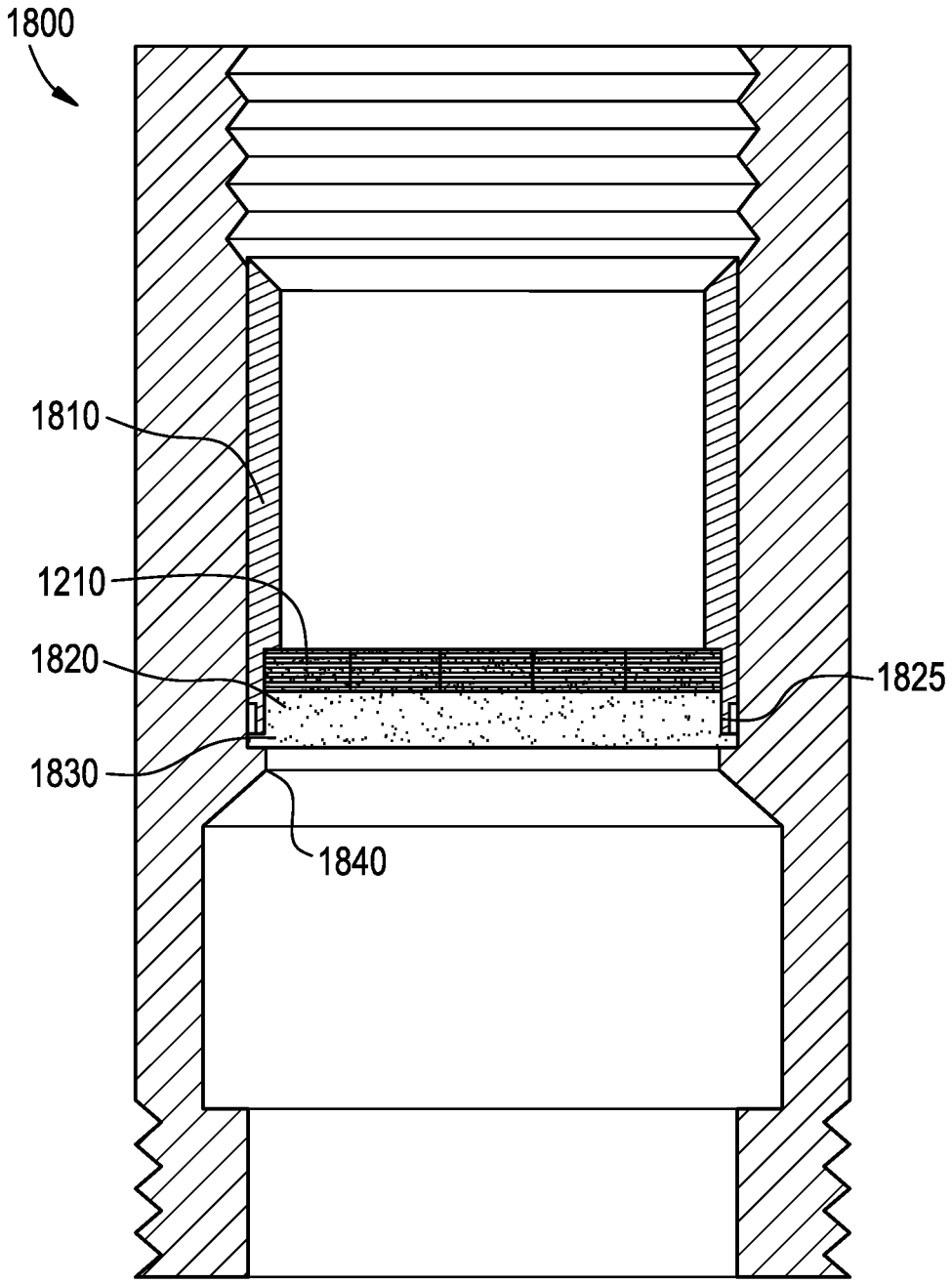
FIG. 18 depicts a temporary sealing system, according to an embodiment.

FIG. 18 depicts a temporary sealing system 1800, according to an embodiment. Elements depicted in FIG. 18 may be described above. For the sake of brevity, another description of these elements is omitted.

Holding element 1810 may be a device that is configured to be positioned adjacent to the inner sidewalls of the casing. In embodiments, holding element 1810 may be permanently positioned within the casing or removably inserted within the casing via threads. The threads may allow holding element to rotationally move in a direction in parallel to a central axis of the casing. Holding element 1810 may also be configured to secure first layer 1210 and lower layer 1820 in place.

Lower layer 1820 may be configured to be positioned below first layer 1210 and be configured to be held in place via ledge 1840, holding element 1810, and first layer 1210. Lower layer 1820 may have a body 1830 with a first diameter, and a base 1830 with a second diameter, the first diameter being smaller than the second diameter. Base 1820 may be an outcrop, protrusions, etc. that extends outward from a central axis of lower layer 1820. Body 1830 may have sidewalls that are positioned adjacent to portions of holding element 1810. Base 1830 may have an upper surface that is positioned adjacent to a lower surface of holding element 1810, sidewalls that are positioned adjacent to an inner circumference of the casing, and a lower circumference that is positioned on ledge 1840. As such, the circumference of lower layer 1820 may be sandwiched between holding element 1810, the sidewalls of the casing, and the ledge 1840.

Ledge 1840 may be a platform, seat, etc. that is configured to hold lower layer 1820 in place, and provide a permanently fixed break point, shearing point, etc. of lower layer 1820. Ledge 1840 may have a third diameter, which is smaller than the second diameter and may also be equal to the first diameter. In embodiments, responsive to the pressure within the casing increasing past a predetermined threshold, ledge 1840 may apply pressure against the outcrop formed of base 1830 to shear, break, etc. to shear portions of base 1830 resting on ledge 1840. This may enable portions of lower layer 1820 having a diameter less than the third diameter from passing through ledge 1840. Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for temporarily sealing a wellbore, the system comprising:

a dissolvable and shearable seat positioned within a tool;

a temporary seal configured to be positioned on the dissolvable and shearable seat in a first mode, the temporary seal including a segmented layer comprised of a plurality of segments that are positioned adjacent to each other in a plane in the first mode, wherein the temporary seal and portions of the dissolvable and shearable seat are configured to travel within the tool together after the dissolvable and shearable seat reduces in size.

2. The system of claim 1, wherein the segmented layer includes one or more layers, with a plurality of columns of segments and a plurality of rows of segments, wherein each of the plurality of segments are dissolvable, and the plurality of segments are positioned in a plurality of columns and in a plurality of rows, the plurality of columns extending in a first direction in parallel with a central axis of the tool and the plurality of rows extending in a second direction that is orthogonal to the central axis of the tool.

3. The system of claim 2, wherein a first layer of the segmented layer is coated with a sealant.

4. The system of claim 2, wherein a first layer is formed of a solid disk, wherein a surface of the solid disk includes hatchings.

5. The system of claim 4, wherein the temporary seal is made out of dissolvable, disintegrating, or vanishing segments that change size or shape when contaminated with pre-determined fluid.

6. The system of claim 5, wherein a lower dissolvable layer or surface is not coated with the sealant.

7. The system of claim 2, wherein a first layer of the segmented layer includes a first set of segments, and a second layer of the segmented layer includes a second set of segments, the first set of segments being aligned in a different orientation than the second set of segments.

8. The system of claim 1, further comprising:

a chamber positioned below the temporary seal and the dissolvable and shearable seat plane, the chamber having a larger inner diameter than an inner diameter above the seat, the chamber being configured to allow fluid flowing through the tool to create turbulence within the tool to disengage the plurality of segments from each other.

9. The system of claim 8, wherein the plurality of segments are configured to disengage from each other in the chamber in a second mode.

10. The system of claim 1, wherein the plurality of segments are dissolvable.

11. The system of claim 1, further comprising:

a ledge configured to reduce a size of an inner diameter of the tool, wherein the dissolvable and shearable seat is positioned on the ledge and has a smaller inner diameter than the ledge wherein the temporary seal includes an outcrop that is configured to be positioned on a ledge.

12. The system of claim 1, further comprising:

a holding element configured to move in a direction in parallel to a central axis of the tool to apply a compressive force to an upper surface of the segmented layer in the first mode, wherein the compressive force extends in the direction in parallel to the central axis of the tool.

13. The system of claim 1, further comprising:

a shearing element and a holding element that are connected to each other to apply a compressive force to the segmented layer in the first mode.

14. The system of claim 1, further comprising:

an element configured to support the segmented layer.

15. The system of claim 1, further comprising:

a shearing element with splits configured to support the segmented layer.

16. The system of claim 1, further comprising:

a fixed element embedded within the tool that is configured to support the segmented layer.

17. A method for temporarily sealing a wellbore, the method comprising:

positioning a temporary seal on a dissolvable and shearable seat within a tool, the temporary seal including a segmented layer comprised of a plurality of segments that are positioned adjacent to each other in a plane, wherein in the temporary seal and portions of the dissolvable and shearable seat travel within the tool together after the dissolvable and shearable reduces in size.

18. The method of claim 17, wherein the segmented layer includes one or more layers.

19. The method of claim 18, further comprising:

supporting the segmented layer on a fixed element embedded within the tool.

20. The method of claim 19, further comprising:

coating a first layer of the segmented layer with a sealant.

* * * * *